US005583896A

United States Patent [19]

Hirose et al.

[11] Patent Number: 5,583,896

[45] Date of Patent: Dec. 10, 1996

[54] TRANSMISSION TYPE SLOW POSITRON BEAM GENERATING DEVICE

[75] Inventors: Masafumi Hirose; Masakazu Washio, both of Kanagawa, Japan

[73] Assignee: Sumitomo Heavy Industries, Ltd., Tokyo, Japan

[21] Appl. No.: 550,201

[22] Filed: Oct. 30, 1995

Related U.S. Application Data

[62] Division of Ser. No. 203,628, Mar. 1, 1994, Pat. No. 5,519,738.

[30] Foreign Application Priority Data

Mar. 23, 1993 [JP] Japan ..... 5-063610

[51] Int. Cl.[6] ..... G21G 1/10

[52] U.S. Cl. ..... 376/195

[58] Field of Search ..... 376/190, 194, 376/195, 196, 198, 199, 201; 250/306–309

[56] References Cited

U.S. PATENT DOCUMENTS

| | | | |
|---|---|---|---|
| 4,288,424 | 9/1981 | Neirinckz et al. | 376/189 |
| 4,800,060 | 1/1989 | Goldring | 376/194 |
| 4,867,939 | 9/1989 | Deutch | 376/156 |
| 5,015,851 | 5/1991 | Singh et al. | 250/307 |
| 5,200,619 | 4/1993 | Asoka kumar et al. | 250/307 |

OTHER PUBLICATIONS

T. S. Stein et al., "Production of a monochromatic, low energy positron beam using the $^{11}B(p,n)^{11}C$ reaction*," *Rev. Sci. Instrum.*, vol. 45, No. 7, Jul. 1974, pp. 951–953.

*Primary Examiner*—Daniel D. Wasil

*Attorney, Agent, or Firm*—Burns, Doane, Swecker & Mathis, LLP

[57] ABSTRACT

In a slow positron beam generating device comprising a target member (11) having a $\beta^+$ decay radioisotope producing function for producing, when an incident surface (11*a*) of the target member is irradiated by accelerated particles (10), $\beta^+$ decay radioisotopes due to nuclear reaction within the target member so that the $\beta^+$ decay radioisotopes emit fast positrons around the $\beta^+$ decay radioisotopes, a moderator (12) is disposed nearer to an opposite surface (11*b*) of the target member than the incident surface and has a fast positron moderating function for moderating into slow positrons the fast positrons emitted from the opposite surface. The opposite surface is opposite to the incident surface. An ejecting electrode (13) ejects the slow positrons as a slow positron beam (14). Use may be made of a different target member having not only the $\beta^+$ decay radioisotope producing function but also the fast positron moderating function in order to remove the moderator from the device. In this case, the ejecting electrode is disposed nearer to the opposite surface of the different target member than the incident surface of the different target member.

5 Claims, 3 Drawing Sheets

TRANSMISSION TYPE SLOW POSITRON BEAM GENERATING DEVICE

This application is a divisional of application Ser. No. 08/203,628, filed Mar. 1, 1994, now U.S. Pat. No. 5,519,738.

BACKGROUND OF THE INVENTION

This invention relates to a slow positron beam generating device supplied with accelerated particles for generating a slow positron beam due to a nuclear reaction process.

Generally, a slow positron beam generating device of the type described comprises a target member having an incident surface to be irradiated with accelerated particles produced by a particle accelerator, a moderator, and an ejecting electrode. When the incident surface of the target member is irradiated with the accelerated particles, nuclear reaction is caused to occur to thereby generate $\beta^+$ decay radioisotopes in the target member. The $\beta^+$ decay radioisotopes emit fast positrons (namely, high energy positrons) in every direction. The moderator receives and moderates the fast positrons to emit slow positrons (that is, low energy positrons). Supplied with the slow positrons, the ejecting electrode ejects a slow positron beam.

Use is made of a different target member having a dual function. In the first place, when the incident surface of the different target member is irradiated with the accelerated particles, the different target member produces the $\beta^+$ decay radioisotopes due to nuclear reaction within the target member so that the $\beta^+$ decay radioisotopes emit the fast positrons. In the second place, the different target member moderates the fast positrons to emit the slow positrons.

In a conventional slow positron beam generating device, among the fast positrons emitted in every direction, the fast positrons emitted from the incident surface of the target member are moderated by the moderator into the slow positrons which are ejected by the ejecting electrode as the slow positron beam. When the different target member is used, the slow positrons emitted from the incident surface of the different target member are ejected by the ejecting electrode as the slow positron beam. Thus, in the conventional slow positron beam generating device, either the fast positrons or the slow positrons emitted from the incident surface are used in ejecting the slow positron beam. Therefore, such a slow positron beam generating device is called a reflection type in the art. Such a reflection type slow positron beam generating device is disclosed, for example, by T. S. Stein et al in Rev. Sci. Instrum., Vol. 45, No. 7, July 1974, pages 951–953 (published by the American Institute of Physics), under the title of "Production of a monochromatic, low energy positron beam using the $^{11}B(p,n)^{11}C$ reaction".

The reflection type slow positron beam generating device has been adopted because it is believed that a large amount of the fast positrons are emitted from the incident surface of the target member since most of the $\beta^+$ decay radioisotopes are produced in the vicinity of the incident surface.

However, it is difficult with the reflection type slow positron beam generating device to continuously obtain the slow positron beam of a high intensity in the manner which will later be described.

SUMMARY OF THE INVENTION

It is therefore an object of this invention to provide a slow positron beam generating device which can achieve continuous generation of a high-intensity slow positron beam at a low cost.

Other objects of this invention will become clear as the description proceeds.

According to a first aspect of this invention, there is provided a slow positron beam generating device comprising: a target member having an incident surface and an opposite surface opposite to the incident surface for producing, when the incident surface is irradiated by accelerated particles, $\beta^+$ decay radioisotopes due to nuclear reaction within the target member so that the $\beta^+$ decay radioisotopes emit fast positrons around the $\beta^+$ decay radioisotopes; a moderator disposed nearer to the opposite surface than the incident surface and supplied with the fast positrons emitted from the opposite surface for moderating the fast positrons into slow positrons; and an ejecting electrode for ejecting the slow positrons as a slow positron beam.

According to a second aspect of this invention, there is provided a combination of a particle accelerator for producing accelerated particles and a slow positron beam generating device comprising: a target member having an incident surface and an opposite surface opposite to the incident surface for producing, when the incident surface is irradiated by the accelerated particles, $\beta^+$ decay radioisotopes due to nuclear reaction within the target member so that the $\beta^+$ decay radioisotopes emit fast positrons around the $\beta^+$ decay radioisotopes; a moderator disposed nearer to the opposite surface than the incident surface and supplied with the fast positrons emitted from the opposite surface for moderating the fast positrons into slow positrons; and an ejecting electrode for ejecting the slow positrons as a slow positron beam.

According to a third aspect of this invention, there is provided a slow positron beam generating device comprising: a target member having an incident surface and an opposite surface opposite to the incident surface for producing, when the incident surface is irradiated by accelerated particles, $\beta^+$ decay radioisotopes due nuclear reaction within the target member so that the $\beta^+$ decay radioisotopes emit fast positrons around the $\beta^+$ decay radioisotopes and for moderating the fast positrons into slow positrons; and an ejecting electrode disposed nearer to the opposite surface than the incident surface and supplied with the slow positrons emitted from the opposite surface for ejecting the slow positrons as a slow positron beam.

According to a fourth aspect of this invention, there is provided a combination of a particle accelerator for producing accelerated particles and a slow positron beam generating device comprising: a target member having an incident surface and an opposite surface opposite to the incident surface for producing, when the incident surface is irradiated by the accelerated particles, $\beta^+$ decay radioisotopes due to nuclear reaction within the target member so that the $\beta^+$ decay radioisotopes emit fast positrons around the $\beta^+$ decay radioisotopes and for moderating the fast positrons into slow positrons; and an ejecting electrode disposed nearer to the opposite surface than the incident surface and supplied with the slow positrons emitted from the opposite surface for ejecting the slow positrons as a slow positron beam.

This invention provides a transmission type slow positron beam generating device which makes use of either the fast positrons or the slow positrons emitted from the opposite surface opposite to the incident surface of the target member in order to obtain the slow positron beam. According to the transmission type slow positron beam generating device, the slow positron beam of a high intensity can continuously be obtained.

DESCRIPTION OF THE PREFERRED EMBODIMENTS

Figure 1:
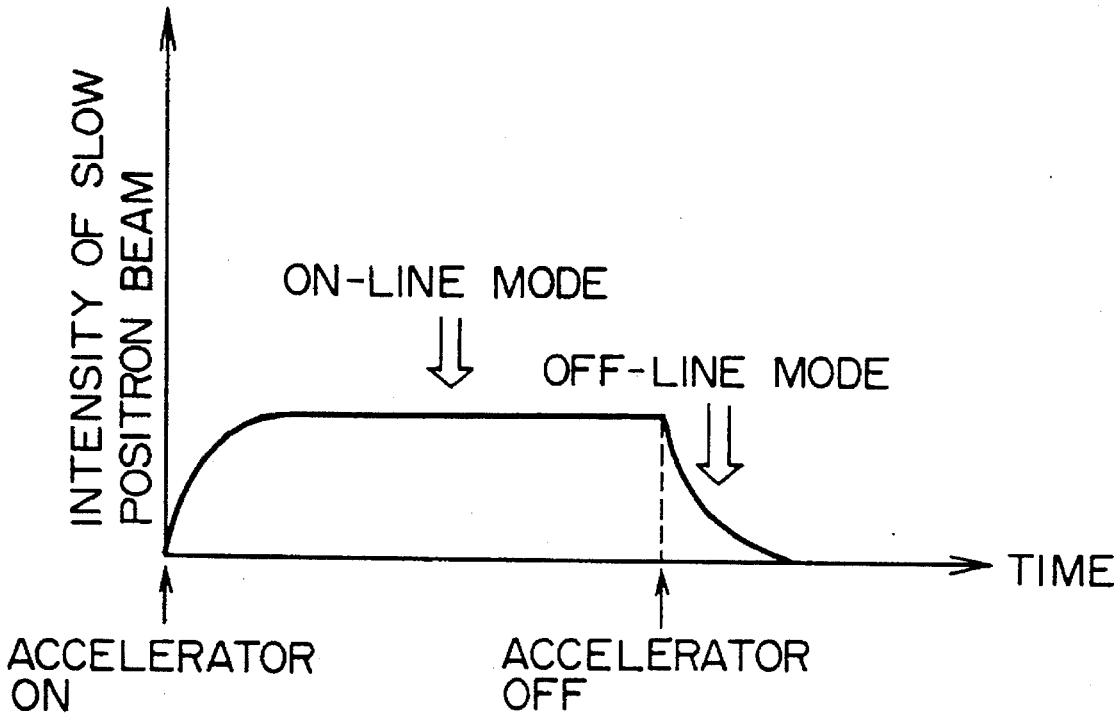
FIG. 1 PRIOR ART
FIG. 1 is a view for use in describing on-line and off-line modes of operation of a particle accelerator.

Referring to FIG. 1, description will first be made as regards disadvantages of the above-mentioned conventional slow positron beam generating device of the reflection type for a better understanding of this invention.

In the first place, it is difficult with the reflection type slow positron beam generating device to use the particle accelerator in an on-line mode in which a high-intensity slow positron beam is continuously used while the particle accelerator is kept in an on state as illustrated in FIG. 1. This is because the moderator (or a moderator portion of the different target member if the different target member has a moderator function as described above) is subjected to a radiation damage by the accelerated particles to decrease the intensity of the slow positron beam. Coexistence of an accelerated particle incident section and a slow positron beam ejecting section inevitably requires a complicated optical system. This results in technical difficulty and an increased cost.

In the second place, when use is made of an off-line mode in which the slow positron beam is used while the accelerator is turned from the on state into an off state as illustrated in FIG. 1, the intensity of the slow positron beam is decreased as shown in FIG. 1. This is because the intensity of the slow positron beam is degraded with lapse of a half life of the $\beta^+$ decay radioisotopes. In order to suppress degradation of the intensity of the slow positron beam, use may be made of the $\beta^+$ decay radioisotopes having a long half life. In this event, however, the slow positron beam can not be quickly generated and stopped. This results in poor controllability or operability.

Thus, it is difficult with the conventional reflection-type slow positron beam generating device to continuously obtain the slow positron beam of a high intensity.

Figure 2:
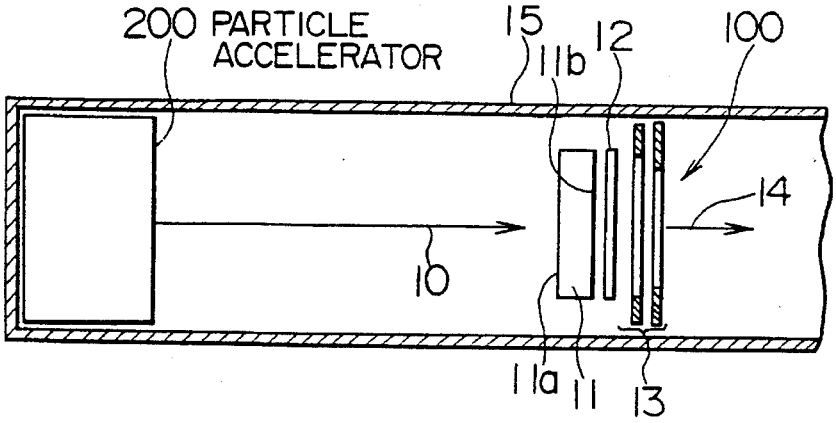
FIG. 2 is a schematic vertical sectional view of a slow positron beam generating device according to a first embodiment of this invention.

Turning to FIG. 2, a slow positron beam generating device 100 according to a first embodiment of this invention is supplied from a particle accelerator 200 with accelerated particles 10. The slow positron beam generating device 100 comprises a target member 11, a moderator 12, and an ejecting electrode 13. The target member 11 has an incident surface 11*a* to be irradiated by the accelerated particles 10. When the incident surface 11*a* is irradiated by the accelerated particles 10, the target member 11 produces $\beta^+$ decay radioisotopes due to nuclear reaction within the target member 11. The $\beta^+$ decay radioisotopes emit fast positrons around the $\beta^+$ decay radioisotopes in every direction. The moderator 12 receives and moderates the fast positrons to emit slow positrons. Supplied with the slow positrons, the ejecting electrode 13 ejects a slow positron beam 14. The slow positron beam generating device and the accelerator are located in a vacuum chamber 15 of, for example, a cylindrical shape.

In this embodiment, the moderator 12 is faced to an opposite surface 11*b* opposite to the incident surface 11*a* of the target member 11. The moderator 12 receives the fast positrons emitted from the opposite surface 11*b* and emits the slow positrons.

The particle accelerator 200 produces, for example, protons as the accelerated particles 10. The target member 11 may be made of aluminum.

The target member 11 is cooled by a coolant.

Figure 3:
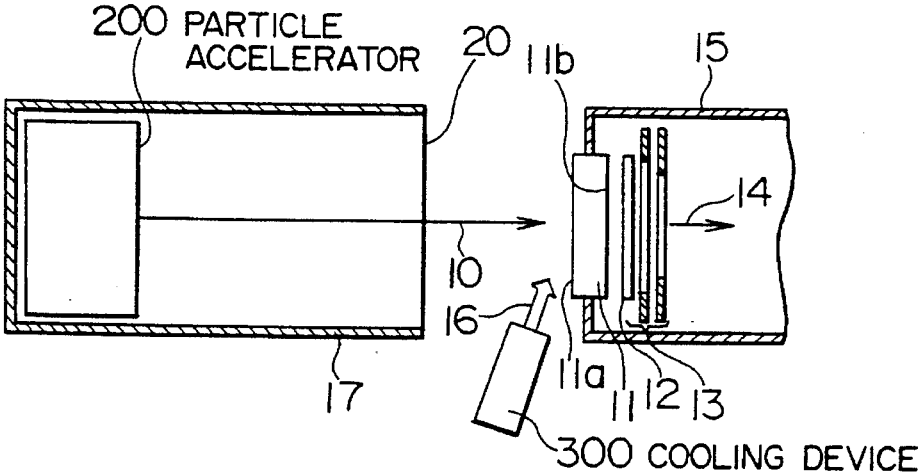
FIG. 3 is a schematic vertical sectional view of a slow positron beam generating device according to a second embodiment of this invention.

Turning to FIG. 3, a slow positron beam generating device according to a second embodiment of this invention is similar to that of FIG. 2 except for the following respects. The moderator 12 and the ejecting electrode 13 are located in the vacuum chamber 15. The target member 11 forms a part of the vacuum chamber 15 with the incident surface 11*a* exposed externally of the vacuum chamber 15. Outside of the vacuum chamber 15, a cooling device 300 is arranged which is for cooling the target member 11 with a cooling fluid such as a cooling gas 16, a coolant, or the like. The particle accelerator 200 is located in another vacuum chamber 17 of, for example, a cylindrical shape. A thin film 20 of, for example, titanium forms a part of the vacuum chamber 17 and allows the accelerated particles 10 to pass through the thin film 20.

Figure 4:
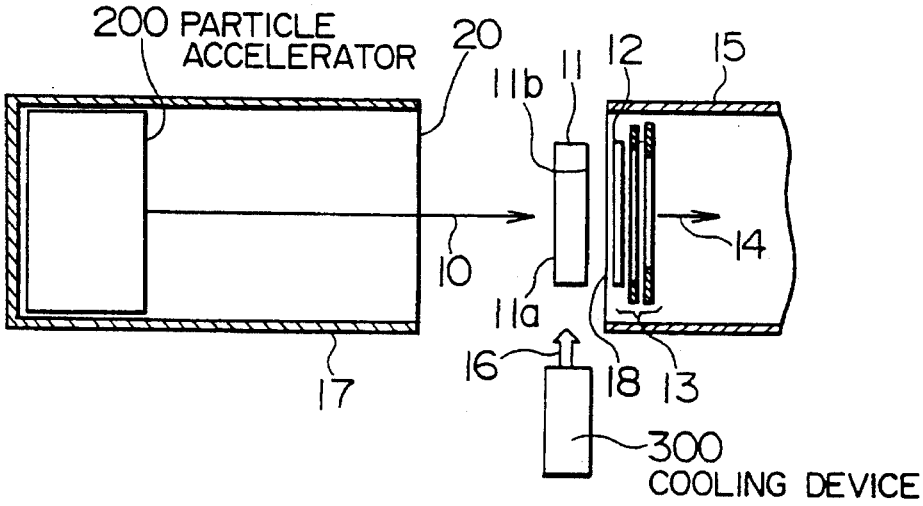
FIG. 4 is a schematic vertical sectional view of a slow positron beam generating device according to a third embodiment of this invention.

Turning to FIG. 4, a slow positron beam generating device according to a third embodiment of this invention is similar to that of FIG. 3 except for the following respects. The moderator 12 and the ejecting electrode 13 are located in the vacuum chamber 15. The target member 11 is located externally of the vacuum chamber 15. Another thin film 18 of, for example, titanium forms a part of the vacuum chamber 15 between the opposite surface 11*b* of the target member 11 and the moderator 12. The thin film 18 allows the fast positrons emitted from the opposite surface 11*b* to pass through the thin film 18. The cooling device 300 is located outside of the vacuum chamber 15 to cool the target member 11 with the cooling fliud such as the cooling gas 16.

Figure 5:
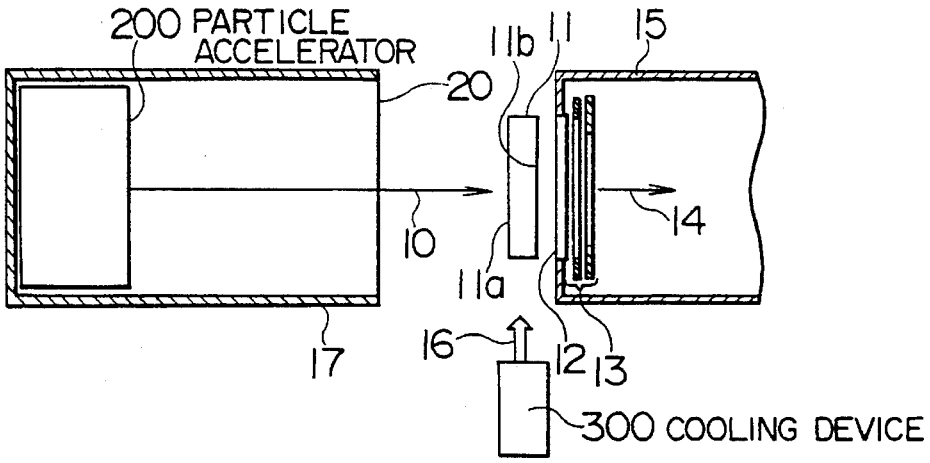
FIG. 5 is a schematic vertical sectional view of a slow positron beam generating device according to a fourth embodiment of this invention.

Turning to FIG. 5, a slow positron beam generating device according to a fourth embodiment of this invention is similar to that of FIG. 4 except for the following respects. The ejecting electrode 13 is located in the vacuum chamber 15. The target member 11 is located externally of the vacuum chamber 15. The moderator 12 forms a part of the vacuum chamber 15 to be faced to the opposite surface 11*b* of the target member 11. The cooling device 300 is located outside of the vacuum chamber 15 to cool the target member 11 with the cooling gas 16.

Figure 6:
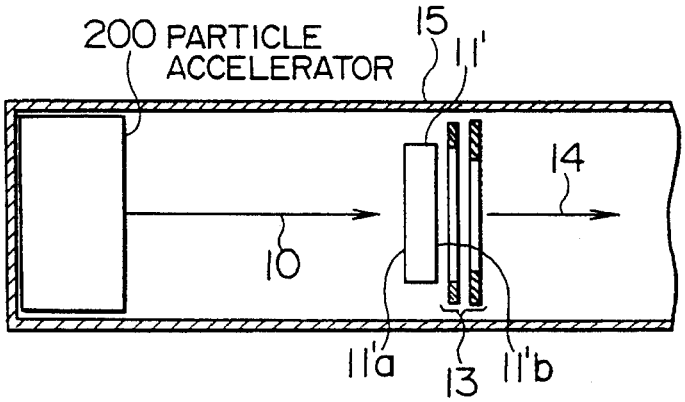
FIG. 6 is a schematic vertical sectional view of a slow positron beam generating device according to a fifth embodiment of this invention.

Turning to FIG. 6, a slow positron beam generating device according to a fifth embodiment of this invention is similar to that of FIG. 2 except for the following respects. A different target member 11' has a $\beta^+$ decay radioisotope producing function for producing, when an incident surface 11'*a* of the target member 11' is irradiated by the accelerated particles 10, $\beta^+$ decay radioisotopes due to nuclear reaction within the target member 11' so that the $\beta^+$ decay radioisotopes emit the fast positrons around the $\beta^+$ decay radioisotopes. The target member 11' further has a fast positron moderating function for moderating the fast positrons emitted from an opposite surface 11'*b* of the target member 11' into the slow positrons. The ejecting electrode 13 is arranged nearer to the opposite surface 11'*b* of the target member 11' than the incident surface 11'*a* of the target member 11'. Supplied with the slow positrons emitted from the opposite surface 11'*b*, the ejecting electrode 13 ejects the slow positron beam 14. Preferably, the target member 11' is cooled by a coolant.

Figure 7:
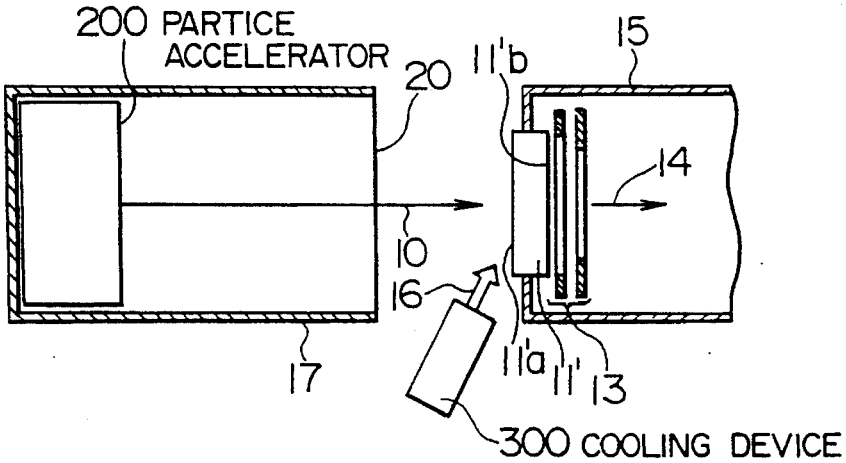
FIG. 7 is a schematic vertical sectional view a slow positron beam generating device according to a sixth embodiment of this invention.

Turning to FIG. 7, a slow positron beam generating device according to a sixth embodiment of this invention is similar to that of FIG. 6 except for the following respects. The ejecting electrode 13 is located in the vacuum chamber 15. The target member 11' forms a part of the vacuum chamber 15 with the incident surface 11'*a* exposed externally of the vacuum chamber 15. Outside of the vacuum chamber 15, the cooling device 300 is arranged to cool the target member 11' with the cooling fluid such as the cooling gas 16. The particle accelerator 200 is located in another vacuum chamber 17.

Now, each of structural components of the first through the sixth embodiments will specifically be described.

Thickness of the Target Member

Each of the target members 11 and 11' has a thickness slightly greater than a range of the accelerated particles 10 within the target member, As a result, all of the accelerated particles 10 incident into the target member are made to stop within the target member, It is therefore possible to avoid radiation damage upon the moderator 12 arranged downstream (or a moderator portion of the target member 11').

It is assumed here that the accelerated particles are protons each of which has an energy of 18 MeV and that the target member is made of aluminum ($^{27}$Al). In aluminum, the protons have a range equal to 1.79 mm. Accordingly, the aluminum target member has a thickness between 1.8 and 2.0 mm. The $\beta^+$ decay radioisotopes ($^{27}$Si) then produced are widely spread in the target member over a depth between 0 and 1.6 mm. Accordingly, a sufficiently large amount of the fast positrons are emitted not only from the incident surfaces 11*a* and 11'*a* but also from the opposite surfaces 11*b* and 11'*b*. If the slow positron beam generating device is of the reflection type and uses the aluminum target member, the slow positron beam 14 has an intensity of $5\times10^5\times\alpha$ (slow $e^+$/s) per a proton current of 1 μA. Herein, α represents attenuation due to the radiation damage and has a value between 0 and 1, both exclusive, and near to 0. With the slow positron beam generating device of the transmission type including the aluminum target member according to this invention, the slow positron beam 14 has an intensity of $4\times10^5$ (slow $e^+$/s). Taking the radiation damage into account, the slow positron beam generating device of the transmission type according to this invention is advantageous as compared with the slow positron beam generating device of the reflection type. Herein, "slow $e^+$/s" represents the number of slow positrons emitted per one second. Results of comparison between the slow positron beam generating devices of the reflection type and of the transmission type are summarized in Table 1.

TABLE 1

| | | | |
|---|---|---|---|
| Target Material | | aluminum ($^{27}$Al) | boron ($^{11}$B) |
| $\beta^+$ Decay Radioisotopes | | $^{27}$Si | $^{11}$C |
| Half-Life | | 4.1 seconds | 20.4 minutes |
| Maximum Energy of Fast Positrons ($\beta^+$ rays) | | 3.85 MeV | 0.96 MeV |
| Saturated Activity | | 8.5 GBq | 9.1 GBq |
| $\beta^+$ Decay Rate | | 100% | 99.76% |
| Reflection Type | Intensity of Slow Positron Beam (slow $e^+$/s) | $5\times10^5\times\alpha$ (1) | $1\times10^5\times\alpha$ (3) |
| | Escape Coefficient | 0.6 | 0.1 |
| Transmission Type | Intensity of Slow Positron Beam (slow $e^+$/s) | $4\times10^5$ (2) | $0.5\times10^5$ (4) |
| | Escape Coefficient | 0.5 | 0.05 |

(For a protom having an energy of 18 MeV and a current value of 1 μA)

The intensity I of the slow positron beam is calculated as follows:

$$I=SA\times E\times F/S\times\alpha,$$

where SA represents a saturated activity, E, an escape coefficient, F/S, a fast positron/slow positron conversion rate.

For a proton having a current value of 1 μA, the intensity I is calculated as follows:

(1) Aluminum Target Reflection Type $$I=8.5\ GBq\times0.6\times10^{-4}\times\alpha=5\times10^5\times\alpha\ (slow\ e^+/s)$$

(2) Aluminum Target Transmission Type $$I=8.5\ GBq\times0.5\times10^{-4}=4\times10^5\ (slow\ e^+/s)$$

(3) Boron Target Reflection Type $$I=9.1\ GBq\times0.1\times10^{-4}\times\alpha=1\times10^5\times\alpha\ (slow\ e^+/s)$$

(4) Boron Target Transmission Type $$I=9.1\ GBq\times0.05\times10^{-4}=0.5\times10^5\ (slow\ e^+/s)$$

Material of the Target Member

Preferably, each of the target members 11 and 11' is made of a material such that the $\beta^+$ decay radioisotopes produced therein emit the fast positrons ($\beta^+$ rays) having an increased maximum energy. As the maximum energy is greater, the fast positrons emitted from the $\beta^+$ radioisotopes effectively escape outwardly from the target member 11 (or effectively reach the moderator portion of the target member 11'). Accordingly, a greater amount of the fast positrons are supplied to the moderator 12 (or the moderator portion of the target member 11') to be moderated. As a result, the slow positron beam 14 has an increased intensity.

It is assumed here that the accelerated particles are protons each of which has an energy of 18 MeV. When the target member is made of aluminum ($^{27}$Al), the $\beta^+$ decay radioisotopes $^{27}$Si are produced and the fast positrons ($\beta^+$ rays) emitted from $^{27}$Si have a maximum energy of 3.85 MeV. When the target member is made of boron ($^{11}$B), the $\beta^+$ decay radioisotopes $11_C$ are produced and the fast positrons ($\beta^+$ rays) emitted from $^{11}$C have a maximum energy no more than 0.96 MeV. Accordingly, escapability (escape coefficient) of the fast positrons in the aluminum target member is ten times as great as that in the boron target member. With the slow positron beam generating device of the transmission type including the aluminum target member, the slow positron beam 14 has an intensity of $4\times10^5$ (slow $e^+$/s) per a proton current of 1 μA. With the slow positron beam generating device of the transmission type including the boron target member, the intensity is equal to $0.5\times10^5$ (slow $e^+$/s). From the foregoing, it will be understood that the aluminum target member is advantageous as compared with the boron target member. This is because the $\beta^+$ decay radioisotopes produced in the aluminum target member emit the fast positrons ($\beta^+$ rays) having a greater maximum energy than those produced in the boron target member (see Table 1).

Use of the aluminum target member improves controllability or operability because the $\beta^+$ decay radioisotopes have a half life as short as four seconds. In addition, the yield of the $\beta^+$ decay radioisotopes are increased to a level on the order of 9 GBq (Becquerel) per a proton current of 1 μA. The $\beta^+$ decay radioisotopes exhibit a decay rate of 100%. As a result, the slow positron beam 14 has an increased intensity.

As described, aluminum is selected as one of candidates of the material of the target member adapted to realize the slow positron beam generating device of the transmission type. Table 1 summarizes results of comparison between the aluminum target member and the boron target member used in the transmission-type and the reflection-type slow positron beam generating devices. As described above, it is understood that the slow positron beam has a higher intensity and an excellent stability in the transmission type than in the reflection type. Likewise, the aluminum target member is superior to the boron target member.

As illustrated in FIGS. 3 through 5 and 7, the accelerated particles 10 are at first directed outwardly of the vacuum chamber 17. The target member 11 or 11' is arranged to form a part of the vacuum chamber 15 (FIGS. 3 and 7) or located externally of the vacuum chamber 15 (FIGS. 4 and 5). With this structure, the target member 11 or 11' can be cooled with an improved efficiency. As compared with the embodiment illustrated in FIG. 2 or 6, an increased amount of the accelerated particles 10 can be irradiated to the target member 11 or 11' so that the intensity of the slow positron beam 14 can furthermore be increased.

In FIGS. 3 and 7, the target member 11 or 11' may be implemented by an aluminum disk having a diameter equal to that of a commercially available gasket. As a consequence, the target member 11 or 11' can readily be installed or exchanged.

The Moderator and the Ejecting Electrode

The moderator 12 is made of a material having a negative work function for the positrons and capable of effectively moderating the fast positrons. Specifically, the moderator may be made of monocrystalline tungsten foil, monocrystalline nickel foil, or the like. Alternatively, polycrystalline tungsten or nickel foil may be used although the efficiency is reduced. The foil is annealed in a vacuum to remove defects therefrom before use. If the target member 11' itself has a negative work function for the positrons, the moderator 12 can be dispensed with. In other words, the target member 11' also serves as the moderator. As described above, a condition used as the moderator 12 is to have a negative work function for the positrons. Therefore, it is not necessary to prepare the moderator 12 separately from the target member 11 when the target member 11 is made of a material having the negative work function for the positrons like the target member 11'. The use of the moderator 12 is allowed even when the target member 11 has the negative work function. When the target member 11 does not have the negative work function for the positrons (that is, when the target member 11 has positive work function for the positrons), the moderator 12 is prepared separately from the target member 11. The fast positrons emitted form the $\beta^+$ decay radioisotopes are moderated by either the moderator 12 or a moderator part of the target member 11' and emitted outside either the moderator 12 or the moderator part of the target member 11' as the slow positrons by the negative work function of the moderator 12 or the moderator part of the target member 11'. When the target member is made of aluminum, the target member has either the positive work function or the negative work function as a principal crystalline plane of the target member. When the target member is made of polycrystalline aluminum, the work function of the target member is indefinite or undecided. In such cases, a separate moderator is prepared. When the target member is made of boron, the target member has the negative work function. In the boron target member, it is not necessary to prepare the moderator.

The moderator 12 is faced to the opposite surface **11*b* of the target member 11 opposite to the incident surface 11*a* so that the accelerated particles 10 do not strike the moderator 12**. As a consequence, it is possible to separate the accelerated particle incident section and the slow positron beam ejecting section. This makes the optical system simpler in the transmission type than in the reflection type. Such simple optical system can be readily manufactured at a reduced cost.

In order to increase the intensity of the slow positron beam 14, the moderator 12 is located as nearly as possible to the target member 11. A positive potential is applied to the moderator 12 so that the ejecting electrode 13, which has a potential of a predetermined polarity, effectively ejects the slow positron beam 14.

The Vacuum Chamber

Both the particle accelerator 200 and the slow positron beam generating device may be accommodated in the single common vacuum chamber as illustrated in FIGS. 2 and 6. However, it is preferable to provide the separate vacuum chambers for the particle accelerator 200 and the slow positron beam generating device, as illustrated in FIGS. 3 through 5 and 7. With this structure, the target member 11 or 11' can be cooled with an improved efficiency so that an increased amount of the accelerated particles can strike the target member 11 or 11'. As a result, the slow positron beam 14 has an increased intensity. In addition, the safety of a system comprising the separate chambers is assured.

As described above, the slow positron beam generating device of the transmission type according to this invention makes it possible to generate a high-intensity slow positron beam in an on-line mode of the accelerator. Thus, the disadvantages in the conventional reflection type slow positron beam generating device is removed according to this invention. In addition, the slow positron beam generating device of the transmission type has a simple optical system as compared with the conventional reflection type device. Such a simple optical system can readily be manufactured at a low cost. Furthermore, the particle accelerator 200 and the slow positron beam generating device are accommodated in the separate vacuum chambers so that the target member 11 or 11' is effectively cooled. As a consequence, an increased amount of the accelerated particles can strike the target member 11 or 11' to thereby increase the intensity of the slow positron beam.

What is claimed is:

1. A slow positron beam generating device comprising:

a target member having an incident surface and an opposite surface opposite to said incident surface for producing, when said incident surface is irradiated by accelerated particles, $\beta^+$ decay radioisotopes due to nuclear reaction within said target member so that said $\beta^+$ decay radioisotopes emit fast positrons around said $\beta^+$ decay radioisotopes and for moderating said fast positrons into slow positrons; and an ejecting electrode disposed nearer to said opposite surface than said incident surface and supplied with said slow positrons emitted from said opposite surface for ejecting said slow positrons as a slow positron beam.

2. A slow positron beam generating device as claimed in claim 1, said accelerated particles being protons produced by a particle accelerator, wherein said target member is made of aluminum.

3. A slow positron beam generating device as claimed in claim 1, wherein said ejecting electrode is located in a vacuum chamber, said target member forming a part of said vacuum chamber with said incident surface exposed outwardly of said vacuum chamber.

4. A slow positron beam generating device as claimed in claim 3, further comprising a cooling device located externally of said vacuum chamber to cool said target member with a cooling fluid.

5. A combination of a particle accelerator for producing accelerated particles and a slow positron beam generating device comprising:

a target member having an incident surface and an opposite surface opposite to said incident surface for producing, when said incident surface is irradiated by said accelerated particles, $\beta^+$ decay radioisotopes due to nuclear reaction within said target member so that said $\beta^+$ decay radioisotopes emit fast positrons around said $\beta^+$ decay radioisotopes and for moderating said fast positrons into slow positrons; and an ejecting electrode disposed nearer to said opposite surface than said incident surface and supplied with said slow positrons emitted from said opposite surface for ejecting said slow positrons as a slow positron beam.

* * * * *